US012427362B2

(12) United States Patent
Liu

(10) Patent No.: US 12,427,362 B2
(45) Date of Patent: Sep. 30, 2025

(54) WEIGHT-ADJUSTABLE BARBELL, AND METHOD FOR ADJUSTING WEIGHT OF BARBELL

(71) Applicant: OHFG TECHNOLOGIES(SHANGHAI) CO., LTD., Shanghai (CN)

(72) Inventor: Ping Liu, Shanghai (CN)

(73) Assignee: OHFG TECHNOLOGIES(SHANGHAI) CO., LTD., Shanghai (CN)

( * ) Notice: Subject to any disclaimer, the term of this patent is extended or adjusted under 35 U.S.C. 154(b) by 290 days.

(21) Appl. No.: 17/981,875

(22) Filed: Nov. 7, 2022

(65) Prior Publication Data

US 2024/0131386 A1 Apr. 25, 2024
US 2024/0226642 A9 Jul. 11, 2024

(30) Foreign Application Priority Data

Oct. 20, 2022 (CN) ..... 202211285877.0

(51) Int. Cl.
*A63B 21/075* (2006.01)
*A63B 21/072* (2006.01)

(52) U.S. Cl.
CPC ..... *A63B 21/075* (2013.01); *A63B 21/0724* (2013.01); *A63B 21/0728* (2013.01)

(58) Field of Classification Search
CPC ..... A63B 21/075; A63B 21/0724; A63B 21/0728; A63B 21/0726; A63B 71/0036; A63B 23/12; A63B 21/4043; A63B 21/00065; A63B 21/00061; A63B 21/00069; A63B 21/4035
See application file for complete search history.

(56) References Cited

U.S. PATENT DOCUMENTS 3,861,215 A * 1/1975 Bradley ..... A63B 21/00069 482/116
4,960,277 A * 10/1990 LaRossa ..... A63B 21/078 482/142
5,630,776 A * 5/1997 Yang ..... A63B 71/0036 211/198
7,578,771 B1 * 8/2009 Towley, III ..... A63B 21/0728 482/106
8,025,613 B1 * 9/2011 Wang ..... A63B 71/06 482/107
9,138,610 B2 * 9/2015 Lovegrove ..... A63B 21/0004
11,007,397 B2 5/2021 Liu
11,590,380 B2 * 2/2023 Pohl ..... A63B 21/0724
12,011,634 B2 * 6/2024 Pohl ..... A63B 21/0724
(Continued)

*Primary Examiner* — Garrett K Atkinson

(57) ABSTRACT

Provided are a weight-adjustable barbell, and a method for adjusting the weight of the barbell. Cam mechanisms on two sides of a barbell rod assembly have hitching parts and avoidance parts at different angles. The cam mechanisms at different positions are provided with the avoidance parts at different angles. When transmission shafts on two sides rotate at different angles, different numbers of weight plates can be hitched for weight adjustment. Wear-resistant layers are respectively arranged on two sides of bearing layers of the cam mechanisms, so that the weight plates can be prevented from being worn when in contact with the cam mechanisms.

15 Claims, 10 Drawing Sheets

(56) References Cited

U.S. PATENT DOCUMENTS

| | | | | |
|---|---|---|---|---|
| 2002/0022559 | A1* | 2/2002 | Krull | A63B 21/0728 482/106 |
| 2004/0135416 | A1* | 7/2004 | Parker | A47C 9/002 297/377 |
| 2004/0259697 | A1* | 12/2004 | Whetstone | A63B 21/072 482/93 |
| 2005/0051445 | A1* | 3/2005 | Meehan | A63B 71/0036 206/372 |
| 2005/0197238 | A1* | 9/2005 | Parker | A63B 21/4029 482/142 |
| 2009/0042700 | A1* | 2/2009 | Liu | A63B 21/0728 482/107 |
| 2011/0003668 | A1 | 1/2011 | Crawford et al. | |
| 2012/0021877 | A1* | 1/2012 | Lundquist | A63B 21/0728 482/107 |
| 2016/0030796 | A1* | 2/2016 | Lovegrove | A63B 23/12 482/93 |
| 2016/0089560 | A1* | 3/2016 | Smith | A63B 24/0087 482/108 |
| 2016/0166873 | A1* | 6/2016 | Liu | A63B 21/0726 482/107 |
| 2017/0028246 | A1* | 2/2017 | Vorozilchak | A63B 21/4029 |
| 2018/0078810 | A1* | 3/2018 | Chen | A63B 71/0036 |
| 2020/0306578 | A1* | 10/2020 | Pohl | A63B 21/0724 |
| 2022/0249900 | A1 | 8/2022 | Yoon | |
| 2023/0293933 | A1* | 9/2023 | Pohl | A63B 21/0724 482/104 |

* cited by examiner

WEIGHT-ADJUSTABLE BARBELL, AND METHOD FOR ADJUSTING WEIGHT OF BARBELL

FIELD OF TECHNOLOGY

The present disclosure relates to the field of weightlifting equipment, and in particular to a weight-adjustable barbell, and a method for adjusting the weight of the barbell.

BACKGROUND

In weight lifting, the number of weight plates is often adjusted to adjust the weight of a barbell, thereby achieving training objectives in different stages. For barbells for training, it is usually necessary to manually carry weight plates for weight adjustment, and it is inconvenient to adjust weight by repeatedly carry and disassemble the weight plates manually to increase or reduce the weight. In barbell training, the weight plates are usually disassembled frequently and repeatedly. The two adjacent weight plates will lose weight due to friction, and safety problems will occur in the use, mounting or disassembling process of the weight plates. Furthermore, since the weight plates on the barbell are often used and replaced, the wear between the weight plates may lead to risks of unstable mounting of the weight plates and falling of the weight plates. In addition, some weight plates of the barbell are placed in a centralized manner. It is necessary to carry and mount the weight plates when the counterweight of the barbell is adjusted. In the mounting process, the weight plates may injury people or damage the floor, so the counterweight adjusting process is in convenient. Moreover, since the barbell has a large size, a barbell base will occupy large area, which is inconvenient to store.

SUMMARY

The present disclosure provides a weight-adjustable barbell, so that it is convenient to adjust the weight of the barbell. Furthermore, a wear-resistant layer is arranged between weight plates of the barbell and a connected cam sheet, thereby preventing friction between the weight plates and friction between the connected cam sheet and the weight plates.

In order to achieve the above objective, the present disclosure provides the following technical solution:

a weight-adjustable barbell includes a barbell rod assembly, and several pairs of weight plates able to be hitched on two sides of the barbell rod assembly, where two ends of the barbell rod assembly include transmission shafts; several cam mechanisms are sleeved sequentially on each of the transmission shafts in a non-rotatable manner for hitching the weight plates; each of the cam mechanisms includes a bearing layer, wear-resistant layers are respectively arranged on two sides of the bearing layer; and the wear-resistant layers are used to prevent the weight plates from being worn when the weight plates are in contact with the cam mechanisms.

Further, a connecting neck able to be sleeved on the transmission shaft is connected to or integrally formed at centers of wheel sheets on the same side of each of the cam mechanisms; and the two adjacent cam mechanisms are separated by the connecting neck to form a mounting space for mounting the weight plates.

Further, a cam groove with an upper opening is formed in a surface of one side of each of the weight plates; each of the cam mechanisms includes at least one pair of hitching parts and at least one pair of avoidance parts; each pair of the hitching parts are symmetrically arranged by taking a center point of each of the cam mechanisms as a center, each pair of the avoidance parts are symmetrically arranged by taking the center point of each of the cam mechanisms as a center; and a maximum diameter width between the two symmetrical avoidance parts is less than a minimum width of the opening of the cam groove, and a maximum diameter width between the two symmetrical hitching parts is greater than the minimum width of the opening of the cam groove.

Further, several protrusions are arranged on an outer surface of the wear-resistance layer on one side, on which the connecting neck is arranged, of the cam mechanism, and are used to prevent friction between the bearing layer and the weight plates.

Further, a depth of the can groove is less than the sum of the thickness of the bearing layer and the thickness of the wear-resistant layers on two sides of the bearing layer.

Further, a bearing fixing base is mounted at one end of each of the transmission shafts through a bearing, an adjusting wheel disc is arranged on an inner side of the first bearing fixing base, the adjusting wheel disc is sleeved or integrally formed on each of the transmission shafts in a non-rotatable manner, several limiting grooves are formed in the edge of the adjusting wheel disc uniformly at equal angles, and each of the limiting grooves respectively corresponds to one adjusting gear; and an adjusting block sliding groove is formed at the top of the first bearing fixing base, a first spring is mounted in the adjusting block sliding groove, an upper part of the first spring abuts against an adjusting block, and the adjusting block is in limited clamping connection with the limiting grooves.

Further, a second bearing fixing base is arranged at the other end of each of the transmission shafts, a handwheel disc is arranged on an outer side of the second bearing fixing base, the handwheel disc is sleeved on each of the transmission shafts in a non-rotatable manner, an outer circumference of the handwheel disc is provided with several weight scales, and each of the weight scales respectively corresponds to one of the limiting grooves.

Further, the weight-adjustable barbell further includes a folding base for storing the weight plates, where the folding base includes two fixed frames, a connecting plate is arranged between the two fixed frames, an end part of each of the fixed frames is hinged with the connecting plate through rotating shafts that are respectively arranged at two ends of the connecting plate, and each of the fixed frames is folded through the corresponding rotating shaft.

Preferably, several supporting pads are arranged below the folding base, respectively located on lower surfaces of two ends of the two fixed frames, and used to perform leveling when the folding base is placed on the ground.

Preferably, the tops of the other ends of the two fixed frames are respectively fixedly connected to fixed plates, and bottom supports for placing the weight plates are fixedly connected above the fixed plate.

Further, each of the fixed frames includes a straight rod and a bending rod, one end of the straight rod and one end of the bending rod are respectively fixed below the fixed plates, and the other end of the bending rod is bent towards the other end of the straight rod, then is merged in parallel, and is hinged with the connecting plate through the rotating shaft at the end part.

The present disclosure further discloses a folding base of a barbell, including two fixed frames, where a connecting plate is arranged between the two fixed frames, an end part of each of the fixed frames is hinged with the connecting plate through rotating shafts that are respectively arranged at two ends of the connecting plate, each of the fixed frames is folded through the corresponding rotating shaft, and the size of the folded base is greatly reduced, thereby facilitating storage.

Further, several supporting pads are arranged below the folding base, respectively located on lower surfaces of two ends of the two fixed frames, and used to perform leveling when the folding base is placed on the ground.

Further, the tops of the other ends of the two fixed frames are respectively fixedly connected to fixed plates, bottom supports for placing the weight plates is fixedly connected above the fixed plate, and the weight plates can be directly mount on the barbell base without being carried, thereby reducing the risk of falling of the weight plates.

Further, each of the fixed frames includes a straight rod and a bending rod, one end of the straight rod and one end of the bending rod are respectively fixed below the fixed plates, and the other end of the bending rod is bent towards the other end of the straight rod, then is merged in parallel, and is hinged with the connecting plate through the rotating shaft at the end part.

The present disclosure further discloses a method for adjusting the weight of a barbell, including the following steps:

S1: setting the number of gears as N, and setting the rotating angle at each of the gears as $\alpha=(360/N)°$;

S2: setting the number of cam mechanisms as (N−1)*2, where a diameter of each of the cam mechanisms is as same as a size of a cam groove on each of the weight plates;

S3: setting an opening at an upper part of the cam groove on the surface of each of the weight plates;

S4: dividing all the cam mechanisms into two groups that are respectively mounted at two ends of the barbell, and marking a mounting direction on each of the cam mechanisms;

S5: setting one pair of cam mechanisms closest to two sides of a handle as a first cam mechanism group, and cutting two parts of cam sheets in the first cam mechanism group to form a pair of avoidance parts, where the pair of avoidance parts are symmetrically arranged by taking a center point of the cam mechanisms as a center, a maximum diameter width of the two avoidance parts is less than a minimum diameter width of the opening of the cam groove, and a central angle corresponding to the avoidance part on a side part is $\alpha$;

S6: sequentially rotating each of the cam mechanisms on each side of the barbell by $\alpha$ based on the previous cam mechanism, additionally setting a pair of avoidance parts with a central angle being $\alpha$, and setting (N−1) pairs of avoidance parts with a central angle being $\alpha$ on the $(N-1)^{th}$ cam mechanism on a barbell rod on a single side;

S7: sleeving the two groups of cam mechanisms on transmission shafts on left and right sides of the barbell in a non-rotatable manner sequentially according to the marked mounting direction; and S8: inserting the can mechanism into the cam groove of the weight plate along the opening in the cam groove, synchronously rotating the transmission shafts on two sides of the handle to synchronously rotate the cam mechanisms, and respectively hitching (N−1) weight plates on the two sides of the barbell when rotating to the $N^{th}$ gear.

According to the analysis, the present disclosure discloses a weight-adjustable barbell, where several cam mechanisms are arranged on two sides of the barbell rod assembly, the plurality of cam mechanisms are respectively provided with several pairs of hitching parts and avoidance parts with different angles, cam grooves matched with the cam mechanisms are formed in the surfaces of the weight plates, the transmission shafts on two sides of the barbell rod assembly rotate synchronously, the corresponding cam mechanism will hitch the weight plates when the transmission shafts on the two sides rotate synchronously at a certain angle, and different numbers of weight plates can be hitched by rotating different angles, thereby adjusting weight by rotating the transmission shafts and facilitating use.

Rotating control of the transmission shafts is realized by limiting and fixing the limiting grooves of the adjusting wheel discs on the transmission shafts, and the adjusting block and the first spring on the first bearing fixing base, that is, the transmission shafts can be allowed to be rotated only when the adjusting block is pressed, thereby avoiding falling of the weight plates due to rotation of the transmission shafts during use.

The wear-resistant layers are respectively arranged on two sides of the bearing layers of the cam mechanisms, thereby preventing the weight plates from being worn when the weight plates are in contact with the cam mechanisms and avoiding the phenomena of inaccurate weight and unstable fixation of the weight plates due to wear.

Several protrusions are arranged on the outer surface of the wear-resistance layer on one side, on which the connecting neck is arranged on the cam mechanism, and are used to prevent friction between the cam mechanism and the weight plates.

The depth of the cam groove is less than the sum of the thickness of the bearing layer of the cam mechanism and the thickness of the wear-resistant layers on the two sides of the bearing layer. When the cam mechanism is located in the cam groove, friction between two of the weight plates can be avoided.

according to the method for adjusting the weight of the barbell provided by the present disclosure, different numbers of avoidance parts are arranged on different cam mechanisms, the barbell rod assemblies are sequentially mounted on the cam mechanisms, and the weight gear of the barbell is adjusted through synchronous rotation of the cam mechanisms, thereby facilitating adjustment.

Compared with the prior art, the folding base disclosed by the present disclosure is more convenient to store, and the length after folding is only half of the original length, so that storage is facilitated, the folding mode is simple, and the use process from opening to folding is very convenient.

Compared with the prior art, the weight-adjustable barbell provided by the present disclosure is more convenient in a barbell weight adjusting mode and is more stable and safer in the adjusting process.

BRIEF DESCRIPTION OF THE DRAWINGS

The drawings of the specification that constitutes a part of the present application are used to provide a further understanding of the present disclosure. The exemplary embodiments of the present disclosure and the description thereof are used to explain the present disclosure, and do not constitute an improper limitation of the present disclosure. In the drawings.

DESCRIPTION OF REFERENCE NUMERALS

Figure 1:
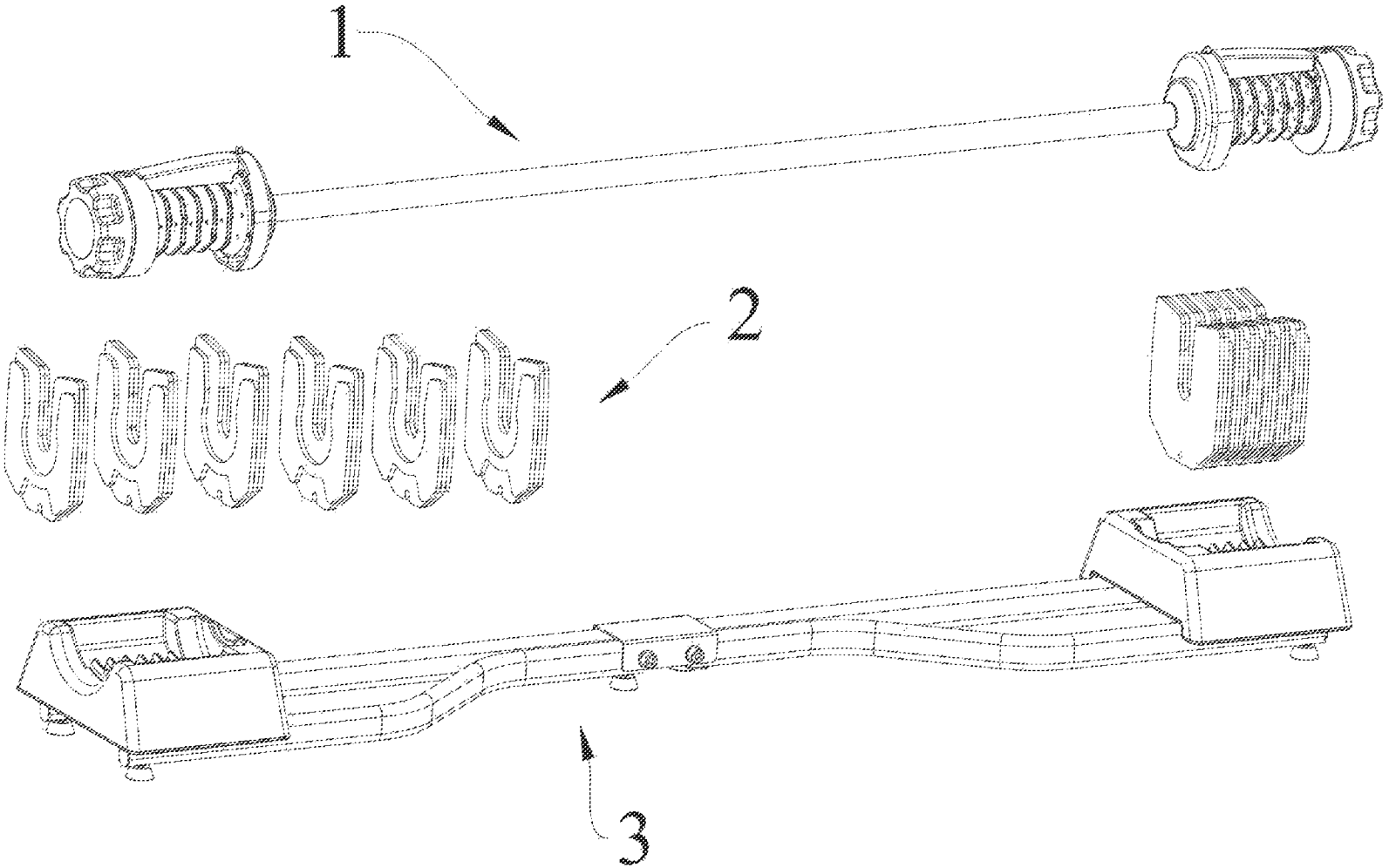
FIG. 1 is a structural schematic diagram of an embodiment.
Figure 2:
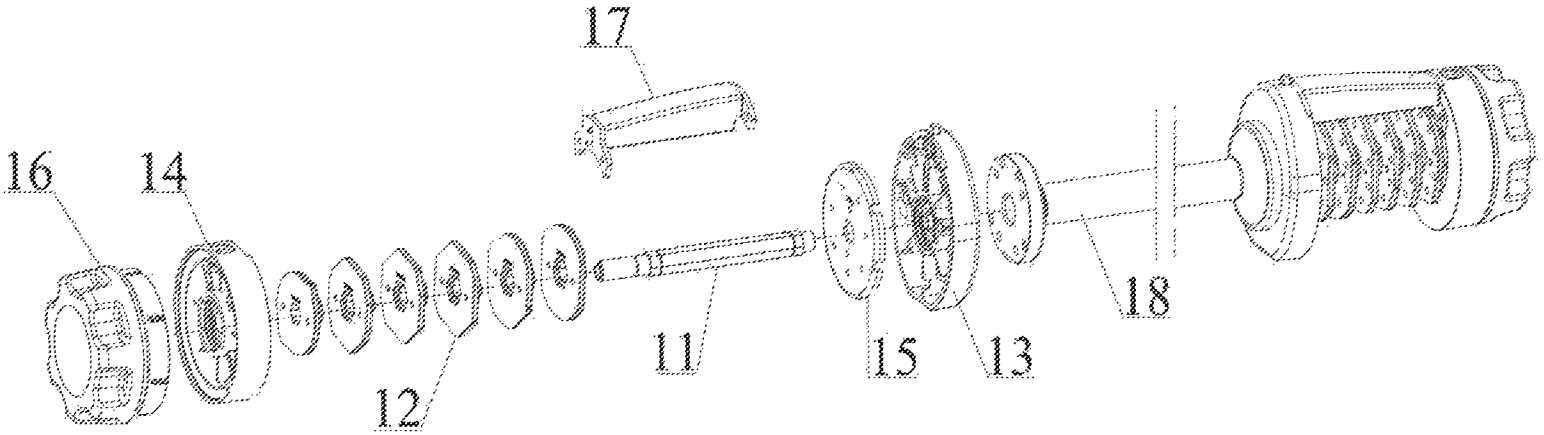
FIG. 2 is a schematic exploded structural diagram of one side of a barbell rod assembly according to an embodiment.
Figure 3:
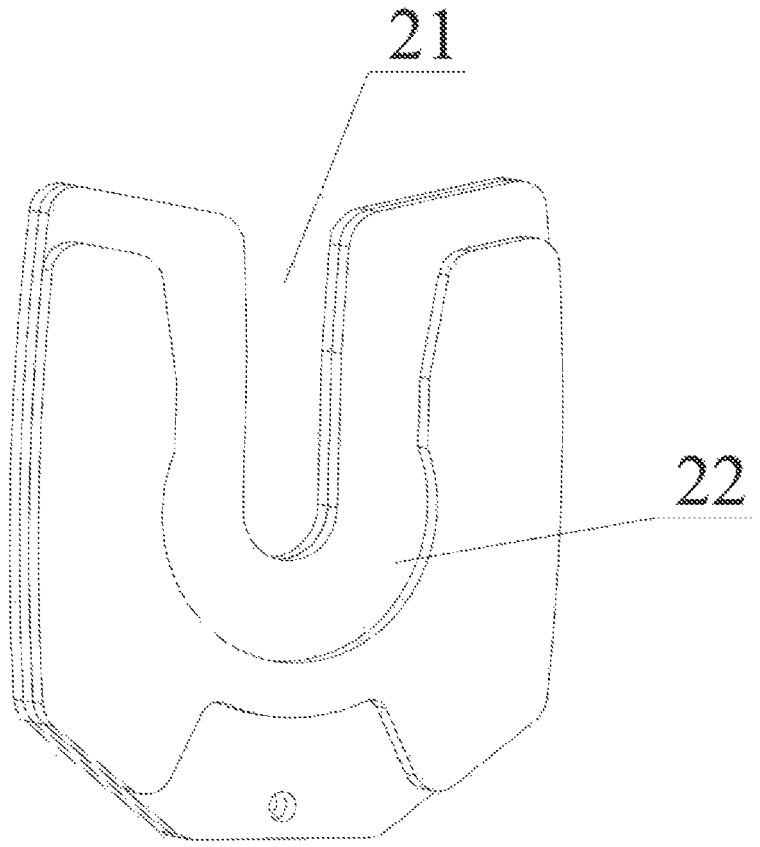
FIG. 3 is a structural schematic diagram of a weight plate according to an embodiment.
Figure 4:
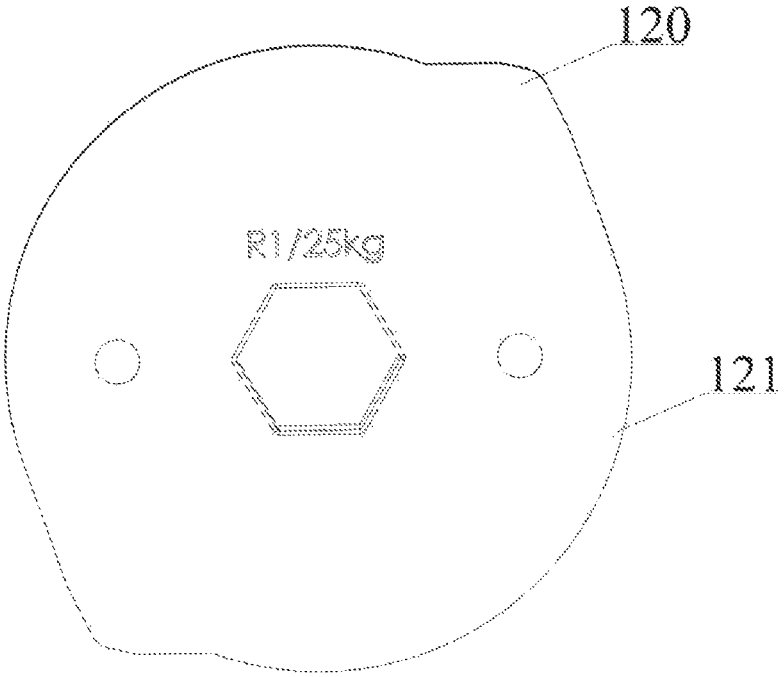
FIG. 4 is a structural schematic diagram of a rear side of a cam mechanism according to an embodiment.
Figure 5:
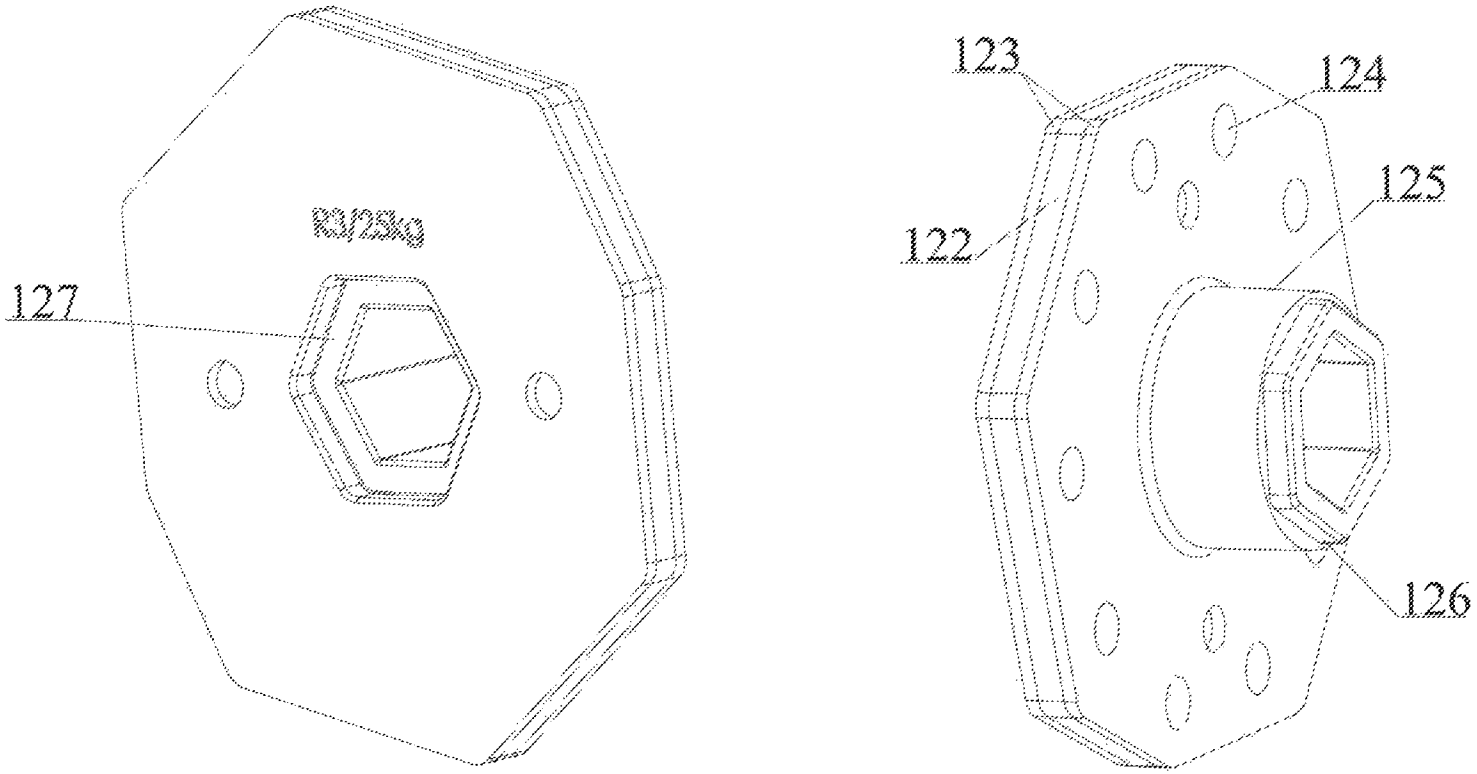
FIG. 5 is a three-dimensional structural schematic diagram respectively showing a front side and a rear side of a cam mechanism according to an embodiment.
Figure 6:
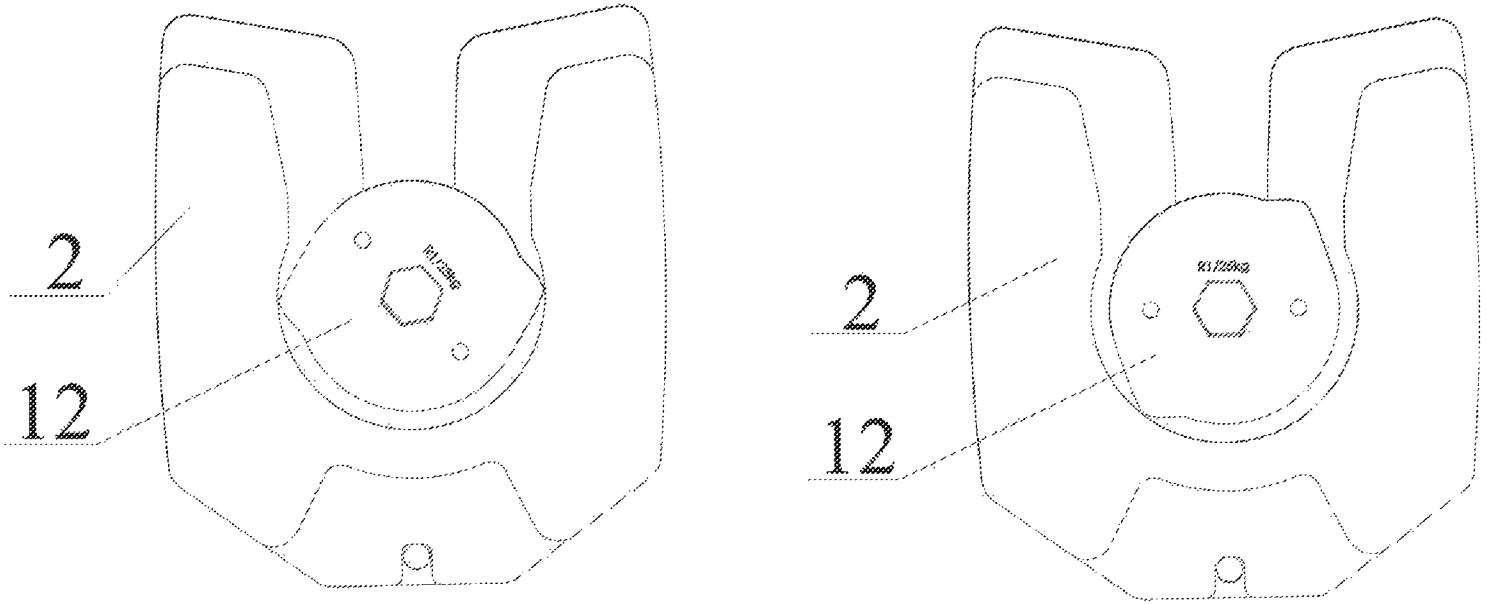
FIG. 6 is a structural schematic diagram of a cam mechanism and a weight plate in two states of hitching and non-hitching according to an embodiment.
Figure 7:
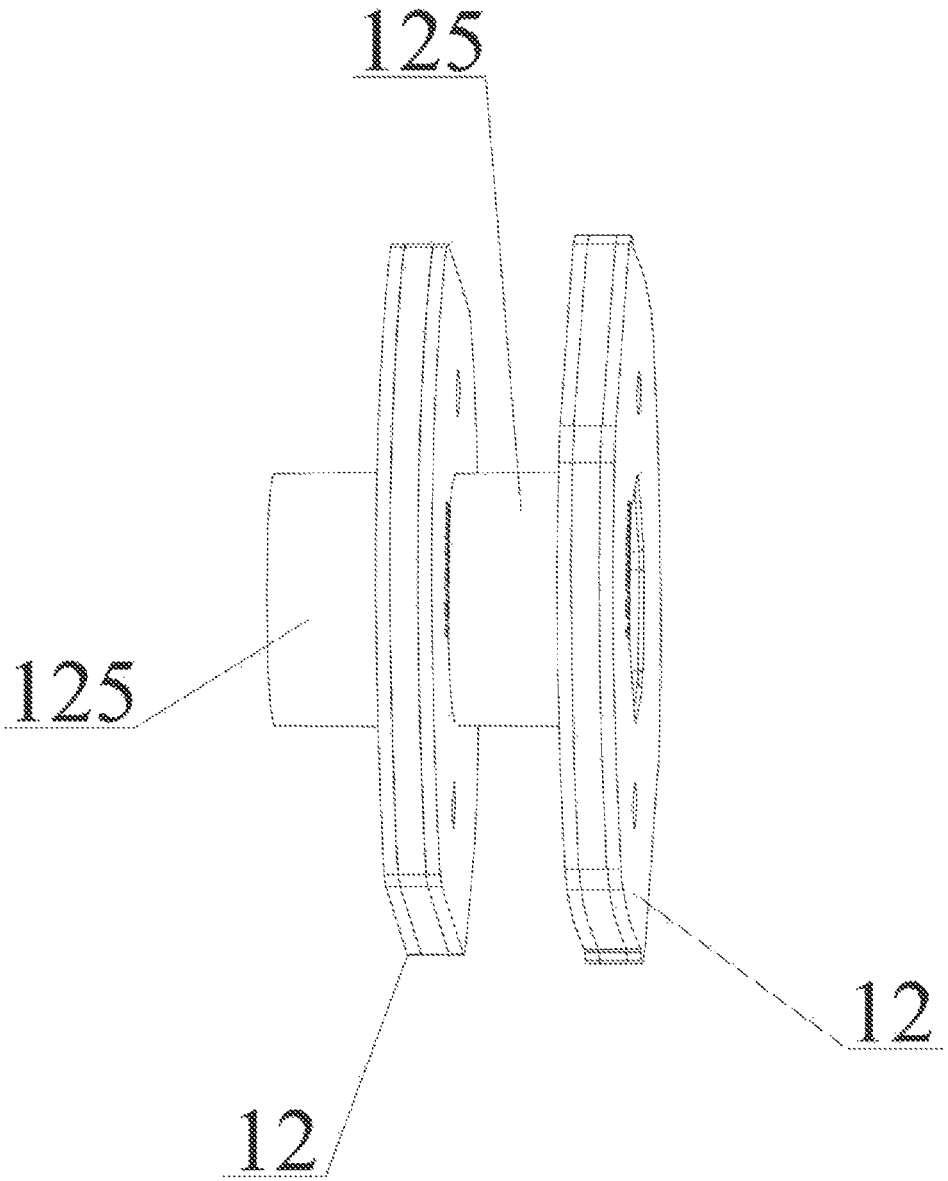
FIG. 7 is a structural schematic diagram of mounting of two cam mechanisms according to an embodiment.
Figure 8:
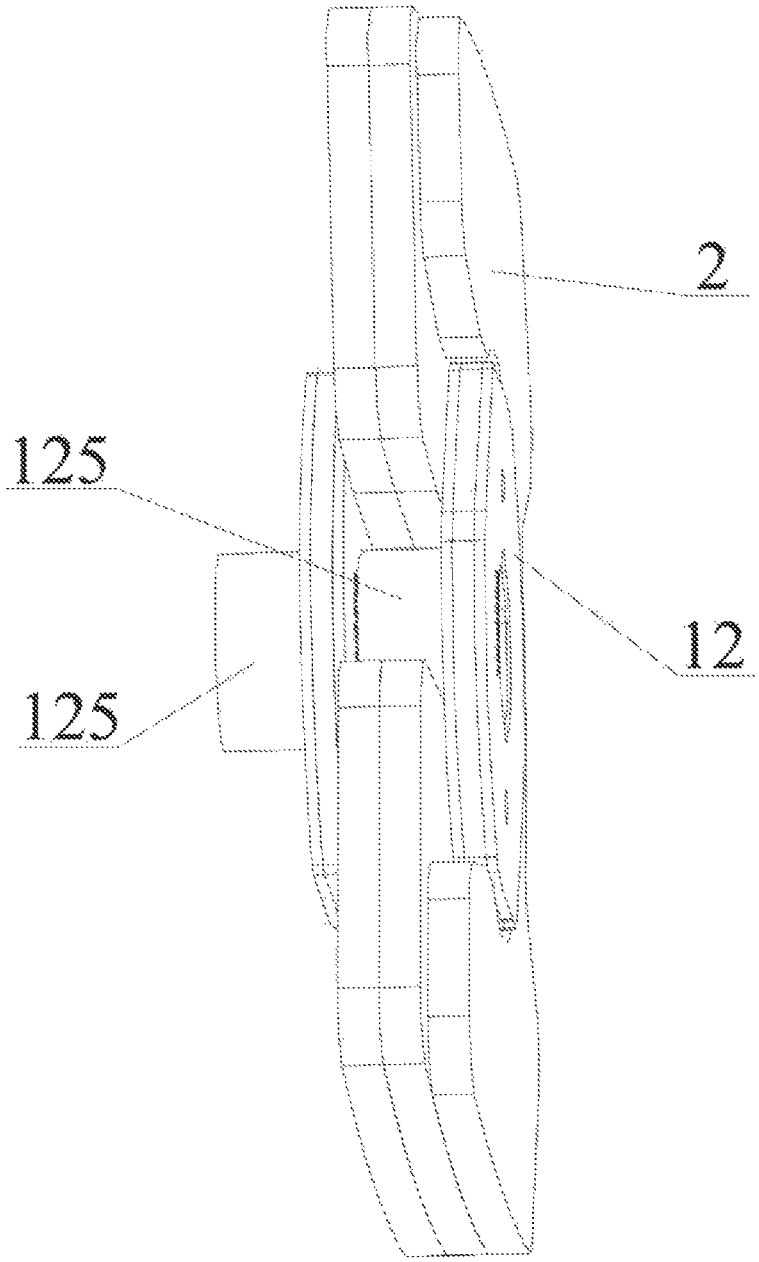
FIG. 8 is a structural schematic diagram of a weight plate hitched between two cam mechanisms according to an embodiment.
Figure 9:
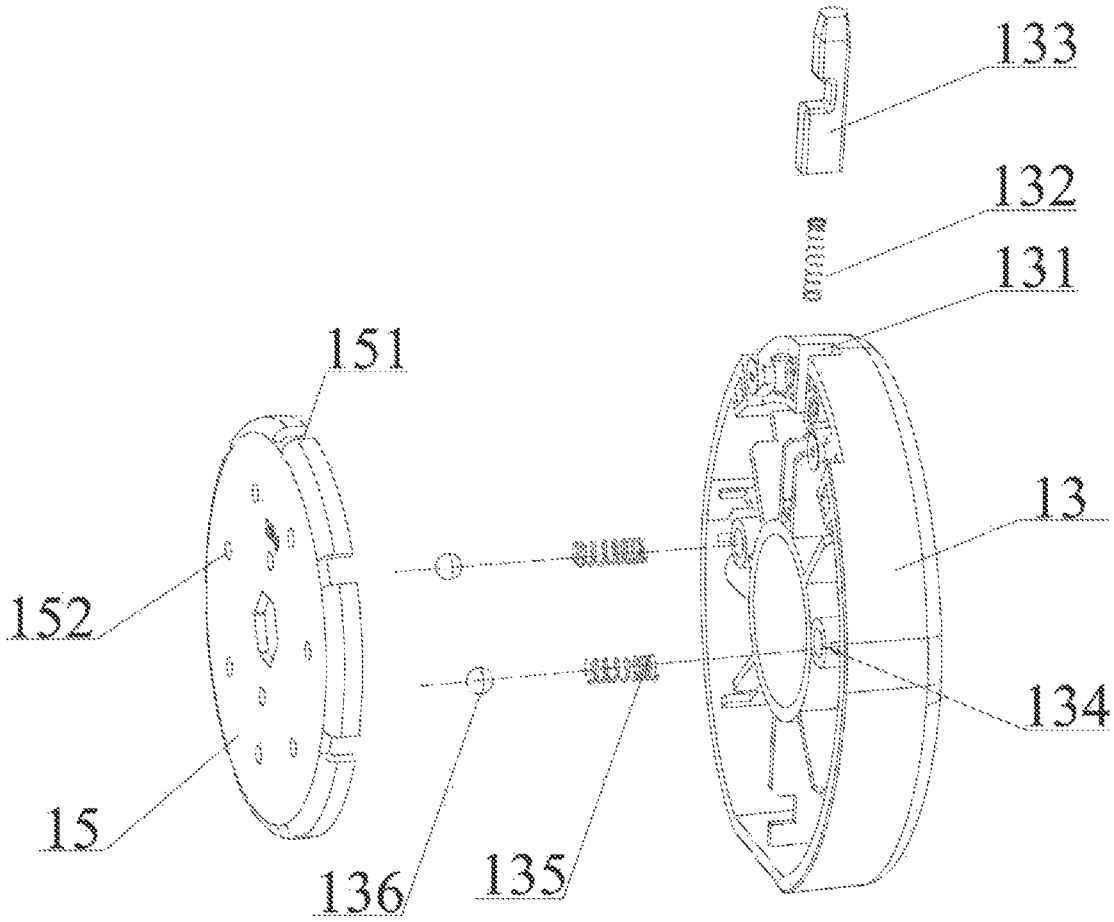
FIG. 9 is a structural schematic diagram of an adjusting wheel disc and a first bearing fixing base according to an embodiment.

1—barbell rod assembly; 11—transmission shaft; 12—cam mechanism; 120—hitching part; 121—avoidance part; 122—bearing layer, 123—wear-resistant layer, 124—protrusion; 125—connecting neck; 126—connecting protrusion; 127—connecting groove; 13—first bearing fixing base; 131—adjusting block sliding groove; 132—first spring, 133—adjusting block; 134—ball placing hole; 135—second spring; 136—ball; 14—second bearing fixing base; 15—adjusting wheel disc; 151—limiting groove; 152—positioning hole; 16—handwheel disc; 17—bridge block; 18—handle; 2—weight plate; 21—notch; 22—cam groove; 3—folding base; 31—fixed frame; 32—connecting plate; 33—rotating shaft; 34—fixed plate; 35—bottom support; 36—supporting pad; 311—straight rod; 312—bending rod.

DETAILED DESCRIPTION OF THE EMBODIMENTS

The present disclosure is described in detail below with reference to the accompanying drawings and embodiments. Each example is provided to explain the present disclosure instead of limiting the present disclosure. In fact, those skilled in the art will appreciate that modifications and variations may be made in the present disclosure without departing from the scope or spirit of the present disclosure. For example, features shown or described as one part of one embodiment may be applied to another embodiment to generate yet another embodiment. Therefore, it is expected that the present disclosure includes such modifications and variations that fall within the scope of the appended claims and their equivalents.

In the description of the present disclosure, orientation or position relationships indicated by terms "longitudinal", "transverse", "upper", "lower", "front", "rear", "left", "right", "vertical", "horizontal", "top", "bottom" and the like are orientation or position relationships shown in the drawings, and these terms are merely for facilitating description of the present disclosure, but not for requiring that the present disclosure must be constructed and operated in a specific orientation, and thus, these terms cannot be understood as a limitation to the present disclosure. As used in the present disclosure, the terms "connected", "connection" and "set" should be understood in a broad sense, for example, they may be fixed connection or detachable connection, they may be direct connection or indirect connection through an intermediate part; or they may be wired connection and wireless connection, or may be connection through a wireless communication signal. For those of ordinary skill in the field, the specific meanings of the terms may be understood according to the specific conditions.

The accompanying drawings show one or more examples of the present disclosure. The detailed description uses reference numerals and letters to refer to the features in the accompanying drawings. Similar numeral references in the drawings and description have been used to refer to the similar parts in the present disclosure. As used herein, the terms "first", "second" and "third" are used interchangeably to distinguish one component from another component, and are not intended to indicate the position or importance of individual components.

Embodiment 1

According to FIG. 1 to FIG. 10, according to the embodiments of the present disclosure, a weight-adjustable barbell is provided. The weight-adjustable barbell includes a barbell rod assembly 1, and six pairs of weight plates 2 able to be hitched on two sides of the barbell rod assembly. Two ends of the barbell rod assembly 1 include transmission shafts 11. Six cam mechanisms 12 are sequentially sleeved on each of the transmission shafts 11 and are used to be hitched with the weight plates 2. Specifically, shaft sections, on which cam mechanisms 12 are mounted, of the transmission shafts 11 are shaft sections with polygonal cross sections, centers of the cam mechanisms 12 have mounting holes of which the cross sections are matched with the cross sections of mounting sections of the transmission shafts 11, and the polygonal structures can limit rotation between the transmission shafts 11 and the cam mechanisms 12. The cam mechanism 12 is provided with at least one pair of hitching parts 120 and at least one pair of avoidance parts 121. Each pair of hitching parts 120 are symmetrically arranged by taking the center of the cam mechanism 12 as a center. Each pair of avoidance parts 121 are symmetrically arranged by taking the center of the cam mechanism 12 as a center. When the hitching parts 120 and the weight plates 2 are hitched, the weight plates are hitched on the transmission shafts 11 through the cam mechanisms 12. Each pair of cam mechanisms 12 has several hitching parts 120 and avoidance parts 121 with different angles. When different cam mechanisms 12 are sequentially sleeved on the transmission shafts 11, different numbers of weight plates 2 can be hitched by rotating at different angles, thereby realizing weight adjustment.

The cam mechanism 12 includes a bearing layer 122. The bearing layer 122 is made of a galvanized iron plate and used to be hitched with the weight plates 2. Wear-resistant layers 123 are respectively arranged on two sides of the bearing layer 122. The wear-resistant layers 123 are made of plastic. When friction occurs between the wear-resistant layers 123 and the weight plates 2, the surfaces of the weight plates 2 are not damaged. A connecting neck 125 is fixedly connected to or integrally formed at a center position of the wear-resistant layer 123 on one side of the bearing layer 122, and a polygonal connecting protrusion 126 is arranged at a free end of the connecting neck 125; a connecting groove 127 with a shape and a size matched with those of the connecting protrusion 126 is formed in the wear-resistant layer 123 on the other side of the bearing layer 122; and the connecting protrusion 126 at the free end of the connecting neck 125 of one cam mechanism 12 is connected to the connecting groove 127 of the other cam mechanism 12, the two adjacent cam mechanisms 12 are separated by the connecting neck 125 to form a mounting space for mounting the weight plates 2.

A notch 21 for the connecting neck 125 to enter is formed in the middle of the weight plate 2. A cam groove 22 that is arranged on the surface of one side of the weight plate 2 and located on the outer side of the notch 21 and has an upper opening is used to accommodate the cam mechanism 12 and realize hitching between the cam mechanism 12 and the weight plate 2. The cross section of the cam groove 22 has a partial circle structure larger than a one-half circle, and the size of the avoidance part 121 of the cam mechanism 12 is less than the size of the opening of the cam groove 22. when the avoidance part 121 is located at the opening of the cam groove 22 and the cam mechanism 12 is lifted upwards, the cam mechanism 12 is unhitched with the weight plate 2. A maximum diameter width of each pair of hitching parts 120 of the cam mechanism 12 is greater than a minimum width of the opening of the cam groove 22. When a pair of hitching parts 120 are located at the opening of the cam groove 22 and the cam mechanism 12 is lifted upwards, the cam mechanism 12 is hitched with the weight plate 2. A plurality of protrusions 124 are arranged on an outer surface of the wear-resistant layer 123 on one side, on which the connecting neck 125 is arranged, of the cam mechanism 12. When the connecting neck 125 of the cam mechanism 12 enters the weight plate 2 from the notch 21, the protrusions 124 are in contact with the interior of the cam groove 22 and used to prevent friction between the bearing layer 122 and the weight plate 2. In this embodiment, the protrusions 124 are convex points, but are not limited to the convex-point structures, and may also have a structure capable of protruding out of the outer surface of the wear-resistant layer 123, such as a convex strip and a convex ring. The depth of the cam groove 22 is less than the sum of the thickness of the bearing layer 122 of the cam mechanism 12 and the thickness of the wear-resistant layer 123 on the two sides of the bearing layer. When the cam mechanism 12 is located in the cam groove 22, one side, on which the protrusion 124 is not arranged, of the cam mechanism 12 is higher than the cam groove 22, thereby preventing friction between two weight plates 2.

After six cam mechanisms 12 are respectively sleeved on the transmission shaft 11 on each side, a first bearing fixing base 13 and a second shaft fixing base 14 are respectively arranged on two end parts of the transmission shaft 11 on each side; the first bearing fixing base 13 and the second bearing fixing base 14 are respectively mounted on the transmission shaft 11 through a bearing; and the transmission shaft 11 may rotate relative to the first bearing fixing base 13 and the second bearing fixing base 14. An adjusting wheel disc 15 is arranged on an inner side of the first bearing fixing base; the adjusting wheel disc 15 is sleeved on the transmission shaft 11 in a non-rotatable manner; seven limiting grooves 151 are arranged on the edge of the adjusting wheel disc 15 uniformly at equal angles; correspondingly, an adjusting block sliding groove 131 is formed at the top of the first bearing fixing base 13; a first spring 132 is mounted in the adjusting block sliding groove 131; an upper part of the first spring 132 abuts against an adjusting block 133 for being in clamping connection with the limiting groove 151; when an end part of the adjusting block 133 is pressed and the adjusting block 133 presses the first spring 132 tightly, the adjusting block 133 relieves clamping connection with the limiting groove 151, and the adjusting wheel disc 15 may rotate relative to the first bearing fixing base 13, that is, the transmission shaft 11 may rotate relative to the first bearing fixing base 13 for weight adjustment; when the adjusting block 133 is loosened, the adjusting block 133 moves upwards under the action of the first spring 132, and the adjusting block 133 is in clamping connection with the limiting groove 151; and at this time, the transmission shaft 11 cannot rotate relative to the first bearing fixing base 13, that is, weight adjustment cannot be performed, thereby effectively avoiding falling of the weight plate 2 caused by relative rotation of the transmission shaft 11 during use. Two ball placing holes 134 are formed on the inner side of the first bearing fixing base 13; second springs 135 are mounted in the ball placing holes 134; outer sides of the second springs 135 abut against balls 136; correspondingly, seven positioning holes 152 are formed in the adjusting wheel disc 15 at equal angles along a circumferential direction and respectively correspond seven adjusting gears of the adjusting wheel disc 15; the two ball placing holes 134 are opposite to two of the positioning holes 152; and when each gear is rotated, the two balls 136 are respectively located in two positioning holes 152, and at this time, there will be a limiting sound from balls, thereby facilitating a user to confirm that a gear has been adjusted.

A handwheel disc 16 is arranged on an outer side of the second bearing fixing base 14, the handwheel disc 16 is sleeved on the transmission shaft 11 in a non-rotatable manner, the transmission shaft 11 can be rotated synchronously when the handwheel disc 16 is rotated, and the mass can be adjusted by rotating the handwheel 16. The outer circumference of the handwheel disc 16 is provided with seven weight scales that respectively correspond to seven gears of the adjusting wheel disc 15; correspondingly, an outer circumferential surface of the second bearing fixing base 14 is provided with weight displaying holes; and when the weight scales on the handwheel disc 16 are opposite to the weight displaying holes, the weight of the barbell at this time can be displayed. Upper end parts of the first bearing fixing base 13 and the second bearing fixing base 14 are fixedly connected through a bridge block 17, thereby ensuring the position synchronization of the first bearing fixing base 13 and the second bearing fixing base 14. Two sides of the barbell rod assembly 1 have symmetrical structures, a handle 18 is fixedly connected between the transmission shafts 11 on the two sides in a non-rotatable manner, and the transmission shafts 11 on the two sides of the barbell rod assembly 1 are fixedly connected, thereby realizing synchronous rotation of the transmission shafts 11 on the two sides. The handle 18 includes a straight handle and a bending handle, thereby achieving the training purposes of different users or at different use stages.

Embodiment 2

A method for adjusting the weight of a barbell includes the following specific steps:

S1: the number of gears is set as N, and the rotating angle at each gear is set as $\alpha=(360/N)°$;

S2: the number of cam mechanisms 12 is set as (7−1) *2=12, where the number of the cam mechanisms 12 on a single side of the barbell is 6, and a diameter of each of the cam mechanisms 12 is as same as a size of a cam groove 22 on a weight plate 2;

S3: an opening is formed in an upper part of the cam groove 22 on the surface of the weight plate 2;

S4: all the cam mechanisms 12 are divided into two groups, namely a group L and a group R, the two groups of cam mechanisms 12 are numbered $L_1$, $L_2$ . . . , $L_5$ . . . $L_6$, and $R_1$, $R_2$ . . . , $R_5$ . . . , $R_6$ sequentially from one side away from a handle 18 to a side close to the handle 18, and mounting directions are marked on the cam mechanisms 12;

S5: one pair of cam mechanisms 12 closest to a handle 18 is set as a first cam mechanism group, the cam mechanism 12 with the serial number $L_6$ close to one side of the handle 18 in the L group of mechanisms 12 is taken as the first cam mechanism 12, and two parts of cam sheets of the first cam mechanism 12 are cut to form a pair of avoidance parts 121, where the pair of avoidance parts 121 are symmetrically arranged by taking a center point of the cam mechanism 12 as a center, a maximum diameter width of the two avoidance parts 121 is less than a minimum diameter width of the opening of the cam groove 22, and a central angle corresponding to the avoidance part 121 on a single side is (360/7)°;

S6: each of the cam mechanisms 12 on each side of the barbell is sequentially rotated by (360/7)° based on the previous cam mechanism 12, a pair of avoidance parts 121 with a central angle being (360/7)° are additionally arranged, and on the barbell on a single side:

a pair of avoidance parts 121 with a central angle being (360/7)° are arranged on the first cam mechanism 12;

two pairs of avoidance parts 121 with a central angle being (360/7)° are arranged on a second cam mechanism 12;

. . .

six pairs of avoidance parts 121 with a central angle being (360/7)° are arranged on a sixth cam mechanism 12;

S7: the two groups of cam mechanisms 12 are sleeved on transmission shafts 11 on left and right sides of the barbell in a non-rotatable manner sequentially according to the marked mounting direction; and S8: the cam mechanism 12 is inserted into the cam groove 22 of the weight plate 2 along an opening of the cam groove 22, the transmission shafts 11 on the two sides of the handle 18 are rotated synchronously to rotate the cam mechanism 12, (N−1) weight plates 2 are respectively hitched on the two sides of the barbell when the cam mechanism is rotated to the $N^{th}$ gear, for example, when a first gear is in the initial state, the weight at this time is the weight of the barbell rod assembly 1, and one weight plate 2 is respectively hitched on the two sides of the barbell when the cam mechanism is rotated to a second gear.

Further, in S4, the cam mechanisms 12 may also be numbered from one side close to the handle 18 to one side away from the handle 18; in S5, the cam mechanism 12 on one side farthest away from the handle 18 may be taken as the first cam mechanism, cutting setting is performed sequentially towards a direction close to the handle 18; and the difference between the two steps is only the difference in the sequence direction of sequentially hitching the weight plates 2, and the setting method is completely the same.

Figure 11:
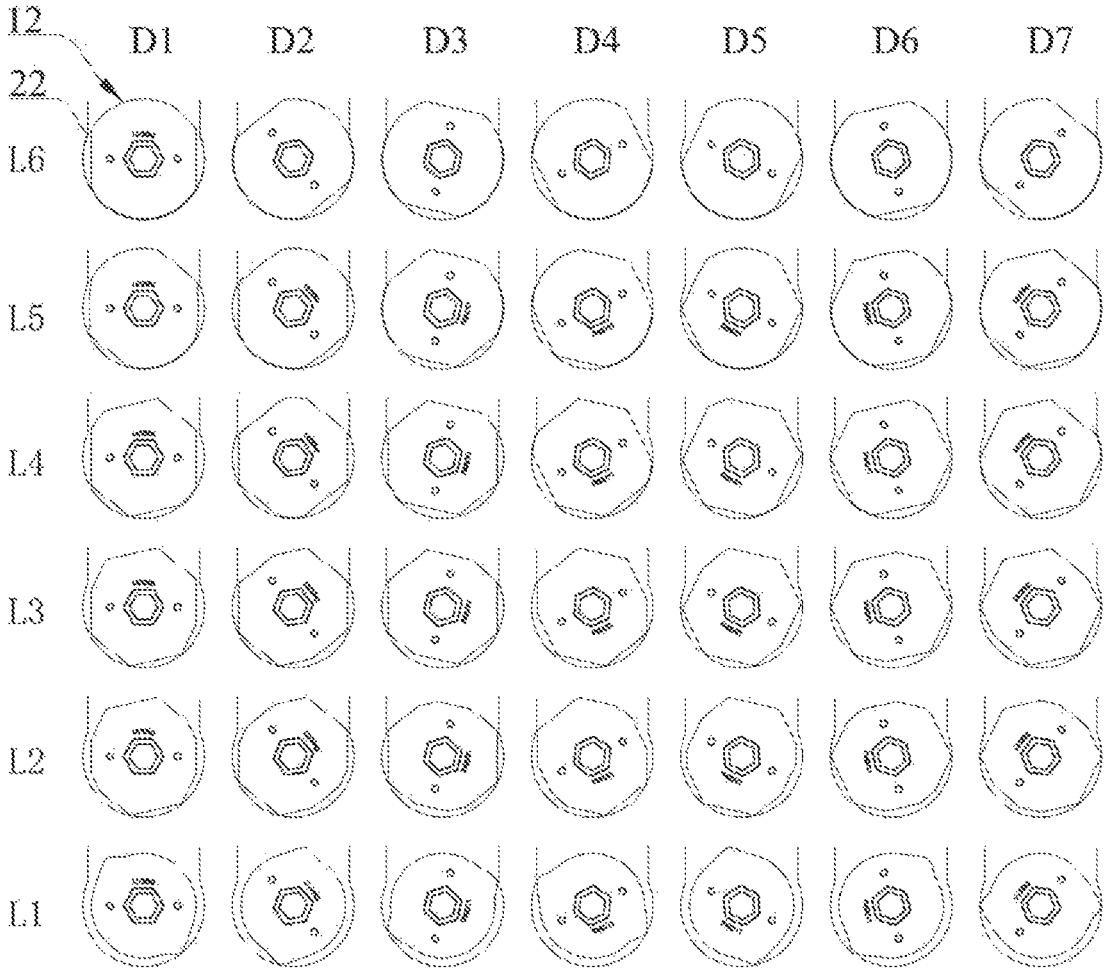
FIG. 11 is a schematic diagram of structures and gear adjustment of six cam mechanisms on a single side of a barbell according to an embodiment.

As shown in FIG. 11 which is a schematic diagram of a rotating state of a cam mechanism on one side of a barbell rod assembly 1 in a cam groove 22, L1 to L6 are respectively the serial number of each cam mechanism 12 from one side away from the handle 18 to one side close to the handle 18, and the columns D1 to D7 respectively represent the rotating state of each cam mechanism 12 in the cam groove 22. In this embodiment, the number of the barbell adjusting gears is set to be 7, and the number of the cam mechanisms 12 arranged on one side of the barbell rod assembly 1 is 6. As shown in the figure, the column D1 is the state where each cam mechanism 12 is initially mounted on the barbell rod assembly 1, and the weight plate is not hitched on each cam mechanism 12 at this time. When the barbell rod assembly is rotated to the second gear, the cam mechanism with the serial number L6 is hitched with the weight plate, others are not hitched, and the total weight of the barbell is the weight of the barbell rod assembly at this time; and from the second column to the seventh column, when the cam mechanism 12 on the barbell rod assembly is sequentially rotated by adding one gear, one cam mechanism 12 is added to be hitched with the weight plate, as shown in the column D3 which is the matching situation in the third-gear state, the cam mechanisms 12 with the serial numbers being L6 and L5 are respectively hitched with the weight plates.

Embodiment 3

Figure 10:
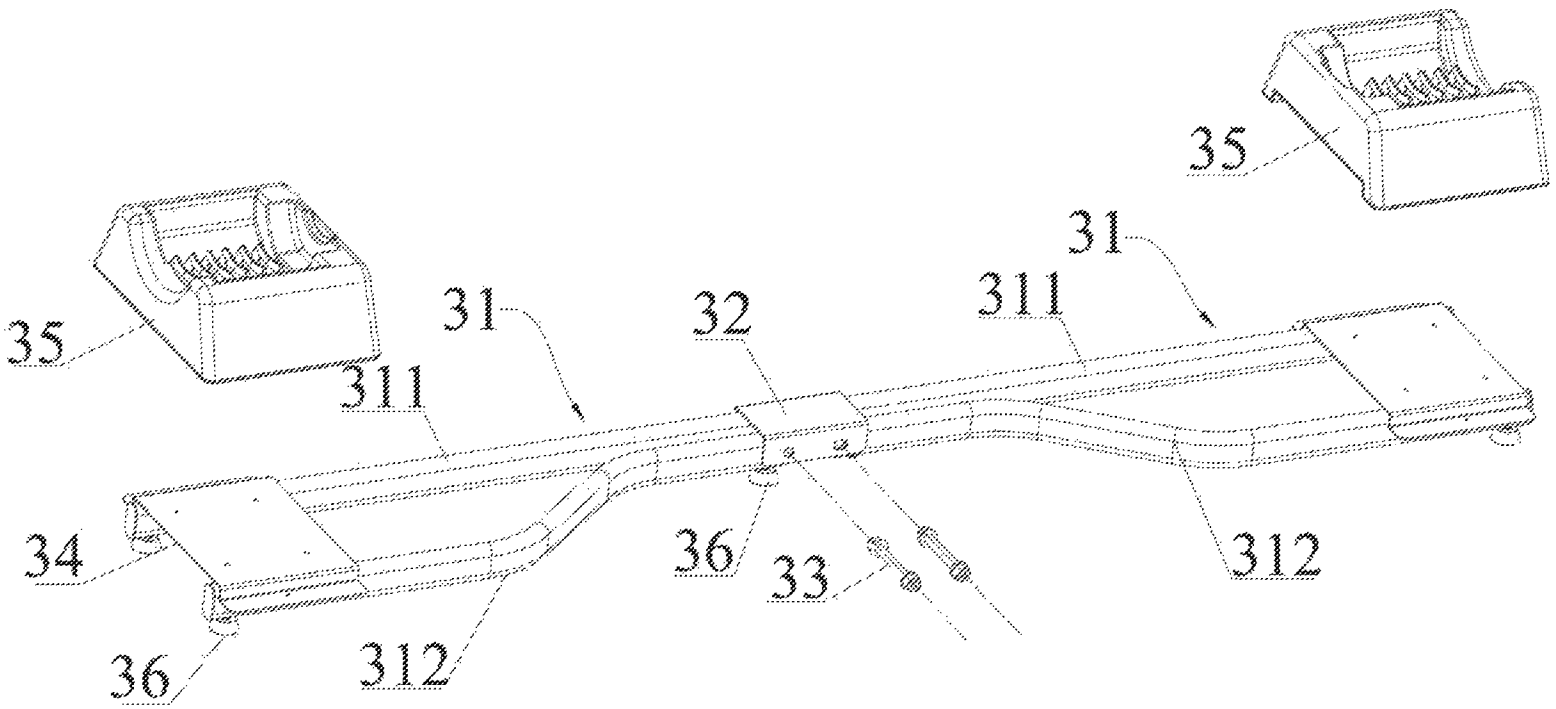
FIG. 10 is a schematic exploded structural diagram of a folding base according to an embodiment.

As shown in FIG. 1 and FIG. 10, the present disclosure further discloses a folding base 3 for storing weight plates 2. The folding base 3 includes two fixed frames 31, a connecting plate 32 is arranged between the two fixed frames 31, end parts of the two fixed frames 31 are respectively hinged with two ends of the connecting plate 32 through two rotating shafts 33, the two fixed frames 31 may respectively rotate around the corresponding rotating shafts 33, and the folding base 3 is in a folded state when the two fixed frames 31 respectively rotate by 90°.

The tops of the other ends of the two fixed frames 31 are respectively fixedly connected to fixed plates 34, bottom supports 35 for placing the weight plates 2 are fixedly connected above the fixed plates 34, and limiting baffles are arranged in the bottom supports 35 and used to place the weight plates 2 separately, so that the weight plates 2 are mounted on the barbell rod assembly 1 conveniently.

Each of the fixed frames 31 includes a straight rod and a bending rod, where one end of the straight rod and one end of the bending rod are respectively fixed below the fixed plates 34, and the other end of the bending rod is bent towards the other end of the straight rod, then is merged in parallel, and is hinged with the connecting plate 32 through the rotating shaft 33 at the end part. Bending sides of bending rods of the fixed frames 31 on two sides of the folding base 3 are mounted oppositely, and a concave area is formed between the two bending rods, so that it is convenient for a user to stand when grabbing or putting down the barbell.

Several supporting pads 36 are arranged below the folding base 3 and are respectively connected to the lower surfaces of two ends of the straight rods and the bending rods of the two fixed frames 31. When the folding base 3 is unfolded and placed on the ground, the folding base 3 may be leveled by adjusting the height of the corresponding supporting pad 36. During use, it is only necessary to unfold and flatly place the two fixed frames 31 and then adjust the flatly place the supporting pad 36; and during folding and storage, it is only necessary to fold the two fixed frames 31 for storage, thereby reducing the occupied space.

From the above description, it can be seen that the above embodiments of the present disclosure achieve the following technical effects:

1. several cam mechanisms 12 are arranged on two sides of the barbell rod assembly 1, the plurality of cam mechanisms 12 are respectively provided with hitching parts and avoidance parts with different angles, cam grooves 22 matched with the cam mechanisms 12 are formed in the surfaces of the weight plates 2, the transmission shafts on two sides of the barbell rod assembly rotate synchronously, the corresponding cam mechanism 12 will hitch the weight plates 2 when the transmission shafts on the two sides rotate synchronously at a certain angle, and different numbers of weight plates 2 can be hitched by rotating different angles, thereby adjusting weight by rotating the transmission shafts 11 and facilitating use.

2. Rotating control of the transmission shafts 11 is realized by limiting and fixing the limiting grooves 151 of the adjusting wheel discs 15 on the transmission shafts 11, and the adjusting block 133 and the first spring 132 on the first bearing fixing base 13, that is, the transmission shafts 11 can be allowed to be rotated only when the adjusting block 133 is pressed, thereby avoiding falling of the weight plates 2 due to rotation of the transmission shafts 11 during use.

3. The wear-resistant layers 123 are respectively arranged on two sides of the bearing layers 122 of the cam mechanisms 12, thereby preventing the weight plates 2 from being worn when the weight plates 2 are in contact with the cam mechanisms 12 and avoiding the phenomena of inaccurate weight and unstable fixation of the weight plates 2 due to wear.

4. Several protrusions 124 are arranged on the outer surface of the wear-resistance layer 123 on one side, on which the connecting neck 125 is arranged on the cam mechanism 12, and are used to prevent friction between the cam mechanism 12 and the weight plates 2.

5. The depth of the cam groove 22 is less than the sum of the thickness of the bearing layer 122 of the cam mechanism 12 and the thickness of the wear-resistant layers 123 on the two sides of the bearing layer 122. When the cam mechanism 12 is located in the cam groove 22, friction between two of the weight plates can be avoided.

Compared with the prior art, the weight-adjustable barbell provided by the present disclosure is more convenient in a barbell weight adjusting mode and is more stable and safer in the adjusting process.

The above is merely illustrative of the preferred embodiments of the present disclosure and is not intended to limit the present disclosure, and various changes and modifications may be made by those skilled in the art. Any modifications, equivalent substitutions, improvements, etc. made within the spirit and scope of the present disclosure should be included within the protection scope of the present disclosure.

What is claimed is:

1. A weight-adjustable barbell, comprising a barbell rod assembly, and several pairs of weight plates able to be hitched on two sides of the barbell rod assembly, wherein each of two ends of the barbell rod assembly comprise a transmission shaft; several cam mechanisms are sleeved sequentially on each transmission shaft in a non-rotatable manner for hitching the weight plates; each of the cam mechanisms comprises a bearing layer; a wear-resistant layer is respectively arranged on each of two sides of each bearing layer; and the wear-resistant layers are configured to reduce wear of the weight plates when the weight plates are in contact with the cam mechanisms.

2. The weight-adjustable barbell according to claim 1, wherein a connecting neck able to be sleeved on each transmission shaft is connected to or integrally formed at a center of each of the cam mechanisms; and every pair of adjacent cam mechanisms are separated by a corresponding connecting neck to form a mounting space for mounting a corresponding weight plate.

3. The weight-adjustable barbell according to claim 2, several protrusions are arranged on an outer surface of one wear-resistance layer on one side, on which the connecting neck is arranged, of each cam mechanism, and are configured to reduce friction between the one wear-resistance layer of each cam mechanism and a corresponding weight plate.

4. The weight-adjustable barbell according to claim 1, wherein a cam groove with an upper opening is formed in a surface of one side of each of the weight plates; each of the cam mechanisms comprises at least one pair of hitching parts and at least one pair of avoidance parts; each pair of the hitching parts are symmetrically arranged about a center point of each of the cam mechanisms; each pair of the avoidance parts are symmetrically arranged about the center point of each of the cam mechanisms; and a maximum diameter width between each pair of the avoidance parts is less than a minimum width of the upper opening of each cam groove, and a maximum diameter width between each pair of the hitching parts is greater than the minimum width of the upper opening of each cam groove.

5. The weight-adjustable barbell according to claim 4, a depth of each cam groove is less than a sum of a thickness of one bearing layer and two wear-resistant layers of each cam mechanism.

6. The weight-adjustable barbell according to claim 1, a first bearing fixing base is mounted at one end of each transmission shaft, an adjusting wheel disc is arranged on an inner side of each first bearing fixing base, each adjusting wheel disc is sleeved or integrally formed on each transmission shaft in a non-rotatable manner, several limiting grooves are formed in an edge of each adjusting wheel disc uniformly at equal angles, and each of the limiting grooves respectively corresponds to one adjusting gear; and an adjusting block sliding groove is formed at a top of each first bearing fixing base, a first spring is mounted in each adjusting block sliding groove, an upper part of each first spring abuts against a corresponding adjusting block, and each adjusting block is in clamping connection with a corresponding limiting groove.

7. The weight-adjustable barbell according to claim 6, a second bearing fixing base is arranged at an other end of each transmission shaft, a handwheel disc is arranged on an outer side of each second bearing fixing base and sleeved on each transmission shaft in a non-rotatable manner, an outer circumference of each handwheel disc is provided with several weight scales, and each of the weight scales respectively corresponds to one of the limiting grooves.

8. The weight-adjustable barbell according to claim 1, further comprising a folding base for storing the weight plates, wherein the folding base comprises two fixed frames, a connecting plate is arranged between the two fixed frames, each of two ends of the connecting plate is arranged with a rotating shaft configured to hinge with an end part of each of the fixed frames.

9. The weight-adjustable barbell according to claim 8, several supporting pads are arranged below the folding base, respectively located on lower surfaces of two ends of each of the two fixed frames, and configured to perform leveling when the folding base is placed on the ground.

10. The weight-adjustable barbell according to claim 8, a top of another end part of each of the two fixed frames is fixedly connected to a fixed plate, and a bottom support for placing the weight plates is fixedly connected above each fixed plate.

11. The weight-adjustable barbell according to claim 8, wherein each of the fixed frames comprises a straight rod and a bending rod, one end of each straight rod and one end of each bending rod are respectively fixed below a corresponding fixed plate, and each bending rod is bent towards a corresponding straight rod, and another end of each bending rod is parallel to another end of the corresponding straight rod.

12. A folding base of a barbell, the folding base comprising two fixed frames, wherein a connecting plate is arranged between the two fixed frames, each of two ends of the connecting plate is arranged with a rotating shaft configured to hinge with an end part of each of the fixed frames; and wherein each of the fixed frames comprises a straight rod and a bending rod, one end of each straight rod and one end of each bending rod are respectively fixed below a corresponding fixed plate, and each bending rod is bent towards a corresponding straight rod, another end of each bending rod is parallel to another end of the corresponding straight rod, and each fixed frame is hinged with the connecting plate.

13. The folding base of the barbell according to claim 12, wherein several supporting pads are arranged below the folding base, respectively located on lower surfaces of two ends of each of the two fixed frames, and configured to perform leveling when the folding base is placed on the ground.

14. The folding base of the barbell according to claim 12, a top of another end part of each of the two fixed frames is fixedly connected to a fixed plate, and a bottom support for placing the weight plates is fixedly connected above each fixed plate.

15. A manufacturing method of a weight-adjustable barbell, comprising the following steps:

S1: setting a number of gears as N, and setting a rotating angle at each of the gears as $\alpha=(360/N)°$;

S2: setting a number of cam mechanisms as (N−1)*2, wherein a diameter of each of the cam mechanisms is as same as a size of a cam groove on a weight plate;

S3: setting an opening at an upper part of the cam groove on a surface of each of the weight plates;

S4: dividing all the cam mechanisms into two groups that are respectively mounted at two ends of the weight-adjustable barbell, and marking a mounting direction on each of the cam mechanisms;

S5: setting one pair of cam mechanisms adjacent to two sides of a handle as a first cam mechanism group, symmetrically arranging a pair of avoidance parts about a center point of the first cam mechanism group, wherein a maximum diameter width between the pair of the avoidance parts is less than a minimum diameter width of the opening of each cam groove, and a central angle corresponding to each avoidance part on a side part is $\alpha$;

S6: sequentially rotating each of the cam mechanisms on each side of the weight-adjustable barbell by a based on a previous cam mechanism, additionally setting a pair of avoidance parts with the central angle being a, and setting (N−1) pairs of avoidance parts with the central angle being a on the $(N-1)^{th}$ cam mechanism on a barbell rod on a single side;

S7: sleeving the two groups of cam mechanisms on transmission shafts on left and right sides of the weight-adjustable barbell in a non-rotatable manner sequentially according to the marked mounting direction; and S8: inserting each cam mechanism into a corresponding cam groove of a corresponding weight plate along the opening in the corresponding cam groove, synchronously rotating the transmission shafts on two sides of the handle to synchronously rotate each of the cam mechanisms, and respectively hitching (N−1) weight plates on the two sides of the weight-adjustable barbell when rotating to the $N^{th}$ gear.

* * * * *